United States Patent [19]

Kurzke

[11] 4,422,225

[45] Dec. 27, 1983

[54] APPARATUS FOR DEPOSITING A MOVING FIBER STRAND AS FOLDED LOOPS

[75] Inventor: Herbert Kurzke, Bobingen, Fed. Rep. of Germany

[73] Assignee: Vepa Aktiengesellschaft, Riehen, Switzerland

[21] Appl. No.: 77,157

[22] Filed: Sep. 19, 1979

[30] Foreign Application Priority Data

Sep. 19, 1978 [DE] Fed. Rep. of Germany ..... 2840664
Oct. 21, 1978 [DE] Fed. Rep. of Germany ..... 2845881

[51] Int. Cl.[3] ..... B65H 57/76; D01D 7/00
[52] U.S. Cl. ..... 28/289; 51/429
[58] Field of Search ..... 53/116, 429; 28/279, 28/281, 282, 100, 289, 256, 257; 223/32; 28/100, 289; 19/160, 299; 68/177, 178; 34/117, 120; 226/119

[56] References Cited

U.S. PATENT DOCUMENTS

| | | | |
|---|---|---|---|
| 250,601 | 12/1881 | Taylor | 223/32 |
| 1,213,527 | 1/1917 | Morley | 26/25 |
| 1,728,682 | 9/1929 | Kampf | 28/282 |
| 2,477,744 | 8/1949 | Hill et al. | 28/289 X |
| 3,332,595 | 7/1967 | Wetzler | 226/119 |
| 3,341,911 | 9/1967 | Smith | 28/289 X |
| 3,672,819 | 6/1972 | Katsuyama et al. | 28/281 X |
| 3,999,971 | 12/1976 | Drummond | 28/289 X |
| 4,174,799 | 11/1979 | D'Agnolo | 28/281 X |

FOREIGN PATENT DOCUMENTS

| | | | |
|---|---|---|---|
| 1410900 | 7/1970 | Fed. Rep. of Germany | 34/120 |
| 2420332 | 11/1975 | Fed. Rep. of Germany | 28/257 |
| 2420333 | 11/1975 | Fed. Rep. of Germany | 28/289 |
| 2704866 | 8/1978 | Fed. Rep. of Germany . | |
| 2840123 | 2/1980 | Fed. Rep. of Germany . | |
| 47-40582 | 10/1972 | Japan | 28/257 |
| 1265 | of 1868 | United Kingdom | 19/160 |
| 502428 | 3/1939 | United Kingdom | 68/177 |
| 544928 | 5/1942 | United Kingdom | 28/289 |
| 1211681 | 11/1970 | United Kingdom | 28/100 |
| 499200 | 3/1976 | U.S.S.R. | 28/289 |

*Primary Examiner*—Robert Mackey
*Attorney, Agent, or Firm*—Antonelli, Terry & Wands

[57] ABSTRACT

An apparatus for depositing a moving fiber strand as folded loops into a storage means includes means for taking off a strand arriving at high speed from a delivery means, an intermediate depositing means for decelerating the strand and for releasing the strand in a folded condition so that the strand will deposit by free fall into a storage means. In the intermediate depositing means, the strand is deflected into a zigzag position to form a plurality of folded loops by guide elements provided in the depositing means. These guide elements are arranged so that the size of the loops constantly are increased during the movement of the strand through the depositing means so that unnecessary tension on the strand is reduced or avoided. Additionally, a conveyor drum is provided beneath the intermediate depositing means for further decelerating the fall of the folded loops into the storage means, e.g., a can or like container.

1 Claim, 10 Drawing Figures

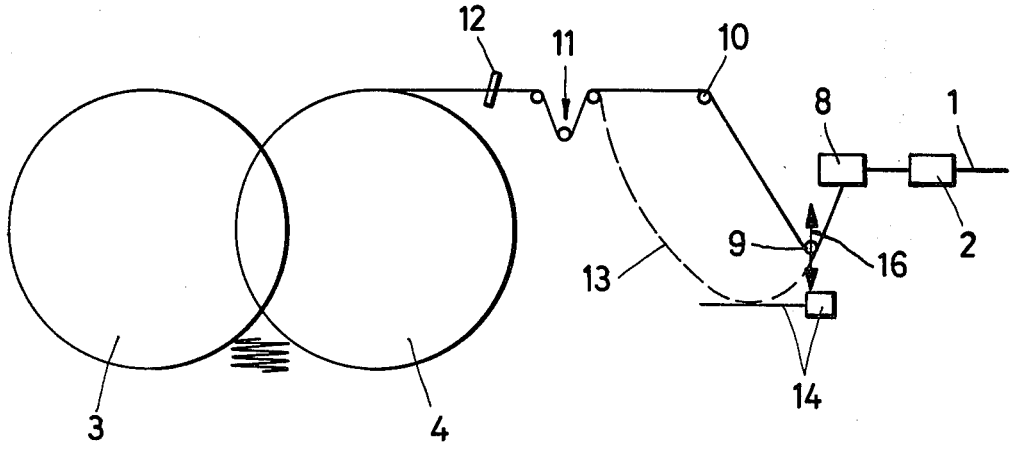
Fig. 7
Fig. 8
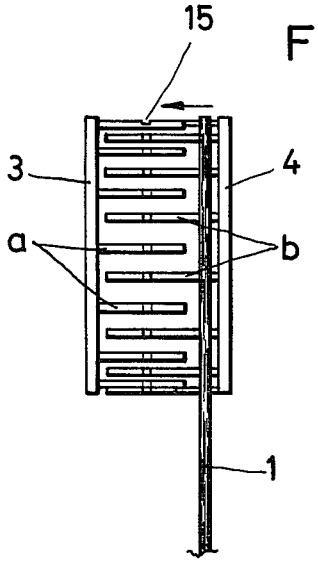
Fig. 9
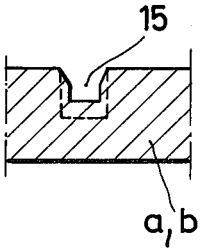

APPARATUS FOR DEPOSITING A MOVING FIBER STRAND AS FOLDED LOOPS

The invention relates, first of all, to an apparatus for the deposition of moving filament or fiber strands wherein the strand material, preferably arriving at high speed, is taken off from a delivery means, then decelerated in an intermediate depository by being moved into a folded position with reference to the unchanged depositing direction, released in this folded condition from the intermediate depository, and then deposited.

The technological development in the spinning of fiber strands has proceeded in a direction toward ever higher delivery speeds of the spun strand from the spinning machine. However, due to this fact, increasing problems are encountered in depositing the spun strand in a storage can, especially because strand velocities of up to more than 6000 m./min. are possible.

It is known, in a velocity range of about 1000 to 1800 m./min., to grasp the strand between the sides of two large, meshing cogwheels (U.S. Pat. No. 1,770,239). During this process, the strand is slightly deformed for a short period of time in correspondence with the shape of the teeth and the interlocking of the cogwheels. However, this deformation does not lead to a permanent crease formation; rather, the strand is stretched under the effect of air currents shortly after the take-off element which here serves merely for conveying purposes. The strand is then disengaged from the cogwheels at a speed lowered in correspondence with the weak crease formation and drops essentially in disarray into a storage can disposed therebelow, which, for the purose of uniform filling, in most cases also executes a reciprocating motion with respect to the pair of cogwheels. It is also known to use, instead of the cogwheels, two interlocking winches for the take-off and feeding of a strand (German Pat. No. 1,109,128).

A considerable disadvantage inherent in these processes resides in that the strand falls into the storage can at a still very high effective velocity in a perpendicular direction and essentially in a stretched condition. For this reason, splitting up of the strand occurs. Besides, the strand, at a high arrival speed, destroys the order and internal coherence of the strand already deposited in the can. This, in turn, causes difficulties during the subsequent take-off of the strands from the can. For these reasons, the conventional processes are no longer useful for take-off speeds of 2000 m./min. and thereabove.

The aforedescribed problems are partially circumvented if the strand is brought, by suitable measures, from the linear motion into a circular motion. The thus-obtained circular rings can then be deposited in the can at a speed greatly reduced in a direction of travel toward the can (DOS [German Unexamined Laid-Open Application] No. 2,331,114 and DOS No. 2,540,148). However, such depositing devices are extraordinarily complicated and are expensive in servicing. For start-up, these devices need a pneumatic conveyance of the strand through an air nozzle until the thus-produced centrifugal force is sufficient for the prevention of coils on the delivery element disposed in front thereof. However, it has been found under practical conditions that the supplemental pneumatic conveying means must, after all, be kept constantly in operation for a safe mode of operation. This is uneconomical. Besides, the pneumatic conveying method destroys the coherence of the strand.

It has furthermore been found necessary to adapt the scrooping (a finishing) treatment of the strand for spinning to the special friction conditions in the above-described take-off element. This is a grave disadvantage, since changes in the scrooping must be tested in a very expensive series of experiments, in order to avoid drawbacks in quality during the further treatment of the strand up to the final consumer.

Furthermore, a process is known from DOS No. 2,261,366 wherein the velocity of the fiber strand is reduced by stepwise deceleration of the fiber strand in such a way that depositing into a can is possible without danger. The strand is moved into moving conveyor elements, the velocity of which is lower than the strand velocity. In particular, it is known herein to provide an intermediate depository for the strand of fibers, consisting of two cooperating conveyor rolls movable in opposite directions of rotation, wherein essentially radial strips are arranged at equal intervals on the outer surface. However, in this example and in all others, the fiber strand impinges on the stacked fiber strand in the conveyor element in the direction of its axis and is forced by overfeeding into arbitrarily formed folds. For this reason, splitting up of the fiber strand and tangling in the strand cannot be avoided. These changes in the coherence of the strand cannot be prevented, either, by utilizing several deceleration stages in succession. This multiplication of the delay units has the additional disadvantage that the take-off element must be placed at a very high level to be able to accommodate therebelow two or three deceleration stages. This makes operation very much more difficult.

The invention is based on the object of developing an apparatus, by which the above-mentioned disadvantages of the prior-art devices are avoided. To attain this object, it is important that the fiber strand is conducted into the storage can only at a low falling velocity—in spite of a high delivery speed—and the fiber strand is not to cause any changes in the already deposited strand when the former arrives in the can, and wherein the strand to be deposited exhibits an unchanged, solid coherence, i.e. no splitting up or tangling.

Starting with the apparatus mentioned in the foregoing, the thus-posed object is attained by providing that the material is guided into a zigzag position by means of guide elements, such as pins, contact surface, or the like, which guide elements move away from one another, are the sole cause for the fold formation, and engage the material alternatingly; and that the folds immediately thereafter are released again by the guide elements and thus are fed in free fall, corresponding to the loop velocity, to a depositing means. The material then falls essentially in correspondence with the tangential velocity of the guide elements under the effect of gravity to a depository. The essential aspect of this process is that the strand, during fold formation, is guided without interruption, and the position and size of the folds are exactly determined by the guide elements. For this reason, no changes in the coherence of the strand can be encountered during the formation of the folds; on the contrary, if the strand should have slightly expanded in volume due to conveying elements connected upstream, the strand will be reunited by the guide elements which engage alternatingly and in direct succession in the strand.

It is expedient to have the guide elements engage the material in each case along the side, i.e. in a horizontal plane, because in such a case the thus-formed folds have a horizontal position. Thereby, there is not only a strong reduction in the falling velocity with respect to the delivery speed, but the strand is also saved from exposure to stresses at right angles to its longitudinal extension during depositing in the can. Thus, by means of this invention, the strand can be decelerated to zero in a storage can without splitting up of the strand or causing any changes regarding the already deposited quantity of strand. Therefore, by this invention a stepwise deceleration of the delivery speed up to the point of depositing is unnecessary.

It is advantageous to deposit the material substantially unchanged in this compact configuration of the loops. Although this measure has been known from DOS No. 2,655,733, the latter discloses folds being deposited in the can, the loops of these folds extending in a perpendicular direction. For this reason, changes can occur, in turn, in the coherence of the strand during impingement of the folds in the can. Besides, there will be the danger at a high fold-forming velocity that the folds detach themselves from the spirals due to the centrifugal speed of the spiral wheel necessary in this construction. As a result, the directional course of the folds entering the can varies in correspondence with the velocity of the spiral wheel. In contrast thereto, in this invention the folds drop, with a horizontal direction, exactly in the same way as they have been formed in the intermediate depository, into the can. A longitudinal overfeeding of the strand thus cannot occur during depositing, not even if, as intended, the strand is immediately braked to zero during depositing.

To avoid the exertion of unnecessary tension on the strand, it is advantageous to fashion the size of the loops in the zigzag position of the material to be constantly on the increase during passage of the material through the intermediate depository. In this connection, a regular zigzag position, but also an irregular zigzag position can be the desired goal. The latter is dependent on the arrangement of the guide elements in the intermediate depository. In this connection, care must be taken that these guide elements do not come into contact with each other during their opposed movement, in spite of extensive overlapping.

To avoid stress on the strand, it is suitable to provide that the guide elements during formation of the folds do not exert excessive longitudinal tension on the strand. For this reason, it is advantageous to guide the strand through an additional conveying means between the delivery device and the fold-forming elements. This effects a low-tension feed of the material into the fold-forming element.

It is possible by the apparatus of this invention to decelerate the strand to be deposited immediately to zero in the can. However, at a high delivery speed of the strand, the consequence here is that, depending on the length of the folds, the latter do drop at a relatively high falling velocity in the direction of the can. This falling velocity, though not causing any changes in the coherence of the strand to be deposited, does possibly effect changes in the bulk of the deposited strand. For this reason, it is advantageous to place the material into loops, to fold it at least once in a denser arrangement prior to the final depositing, and optionally to convey same once more. This is to serve the purpose of not increasing the number of folds to reduce the depositing velocity, but rather of placing the folds in closer juxtaposition whereby automatically an only low falling speed of the strand into the can is achieved.

The apparatus consists of the conventional pair of wheels with two driven, oppositely revolving wheels equipped with interlocking conveying elements. In contrast to the state of the art, these wheels have pins or the like serving as guide elements for the material, so that the material is placed meander-like around the pins or the like. The guide elements can be formed from bilaterally mounted, axially aligned pins, or also from customary gear wheels with a continuous contact surface. In such an arrangement of the folding device, however, only small loops are obtained, unless peripherally larger wheels are utilized which, however, then are difficult to control mechanically at the desired peripheral speeds. It is more advantageous to provide two disks, arranged at a spacing somewhat more than the length of the pin and displaced in parallel to each other, the pins being attached to these disks so that the pins are oriented toward one another and overlap one another. This device has the advantage that the pins can interengage to any desired depth without the mounting of the pins being an impediment.

When adjusting the pair of or disks, care must be taken that the guide elements, during the alternating interlocking, do not come in contact with one another. A safe distance of about 4–8 mm. between neighboring pins on both wheels is to be the desirable objective. An advantage in the apparatus of the invention is that the strand for forming the folds is contacted in each instance only on one side. Thus, the strand cannot be squeezed during passage through the pair of wheels. Rather, the strand is subjected to an especially gentle treatment during the fold formation.

It is expedient, for a low-tension feeding of the material, to arrange in front of the pair of wheels an additional conveying means, for example an injector nozzle, a pair of cogwheels, for the reason that it would be disadvantageous if the pair of pin-equipped wheels were forced to build up a substantial tension with respect to the preliminary take-off device. With the interposition of an injector nozzle, it is also possible to maintain the take-off tension from the preliminary take-off means, required to avoid coils. At the same time, the tension between nozzles and pin-studded wheels is set at any desired low value. The otherwise damaging effect of the injector nozzle, which can destroy the choerence of the strand, cannot come into play here, because the strand is brought again into orderly coherence on the pair of pin-studded wheels.

If, via an intermediate depositing means, folds extending approximately in the horizontal direction are fed to the storage can, it is advantageous to deposit these windings in close juxtaposition. For this reason, it is advantageous to arrange following the intermediate depositing means, a guide means receiving the windings in their widths, which guide means is fashioned as a conveyor. A suitable guide means can be a chute, and, in the form of a conveyor, a driven, rotating conveyor drum or an endless belt. Here again, it is advantageous or even necessary to brake the falling velocity of the windings at the guide means to zero. For this reason, the conveyor drum should be arranged with its horizontally aligned axis vertically below the folded loops falling onto the drum. By the rotation of the conveyor drum, the just-deposited fold is thun removed from the point of impingement and thus conveyed in the direction toward the can. Therefore, the successive loops cannot jam against each other.

Since the folded loops impinge on the guide means at a certain velocity, it can be advantageous to exert a supportive influence on the detachment of the folded loops from the guide means. It is therefore suitable to associate the guide means, especially the conveyor drum, with a stripper. It is expedient to provide the conveyor drum with peripherally parallel grooves engaged by a finger-like strand stripper. In this way, also the filaments directly in contact with the drum will be safely seized by the stripper.

The conveyor drum, as known from DOS No. 2,704,866, can also be fashioned as a sieve drum under a suction draft. Likewise, the conveyor—as is known—can be made to reciprocate to have an effect on the uniform filling of the can. In the present case, it is advantageous to make the conveyor movable about an axis at right angles to the axis of the drum so that the point of impingement of the windings on the drum remains the same.

It is especially suitable to operate the depositing system at an only minor pretension, so that the contact forces dependent on the cross section of the strand likewise become small and thus a maximally gentle treatment of the strand is attained. Besides, in such a case it is especially easily possible to operate the pair of pin-studded wheels at low speed in correspondence with the folding operation.

As mentioned above, this can be achieved by inserting between the preliminary take-off means and the pair of pin-studded wheels, for example, an injector nozzle or a small pair of pin-studded wheels or cogwheels with relatively few pins or teeth and a small loop length, yielding the necessary take-off tension for the preliminary take-off means. The pair of small pin-studded wheels must then revolve approximately at the spinning velocity to attain the required tension for preliminary take-off. The strand is thereafter guided loosely or in a freely hanging loop of a thread brake taking care of a low pretensioning of the strand entering the pair of pin-studded depositing wheels.

The drawings show embodiments of the apparatus according to this invention, to wit:

FIG. 7 shows a frontal view similar to that of FIG. 1 or 3 with an intermediate depositing means connected in front of the device;

FIG. 8 shows an end view of the folding device in an embodiment different from that of FIG. 2; and FIG. 9 is an enlarged fragmentary view of a pin according to FIG. 8.

Figure 2A:
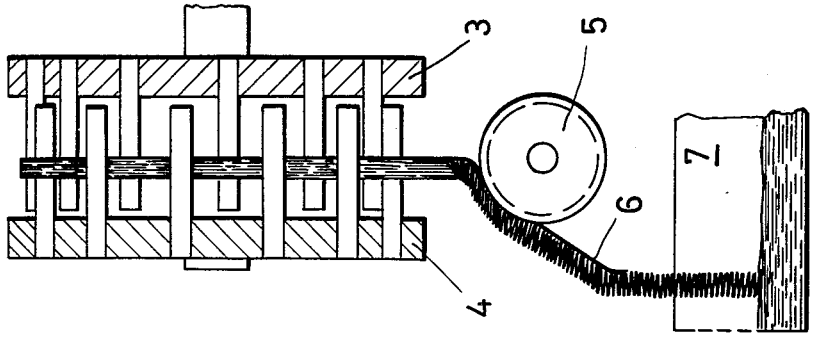
FIG. 2A shows a device according to FIG. 1 in a lateral view.

The spun strand 1 coming from the sprinning machine is fed to the driven revolving pin-studded wheels 3 and 4 via the preliminary take-off means 2. The pin-studded wheels consist of two axially parallel disks or wheels carrying close to their circumferences an equal number of uniformly arranged, axially parallel pins $a_1$, $a_2$ . . . $b_1$, $b_2$. The pin-studded wheels 3 and 4 are arranged so that the rims formed by the pins are in mutual opposition and interlock. The pins are disposed so that, for example, a pin $b_1$ of the wheel 4 is located in the gap between pins $a_1$ and $a_2$ of wheel 3. In case of a synchronous drive of the two wheels 3 and 4, the pin crowns then travel through each other with transposed pins, without the pins contacting each other.

Figure 1:
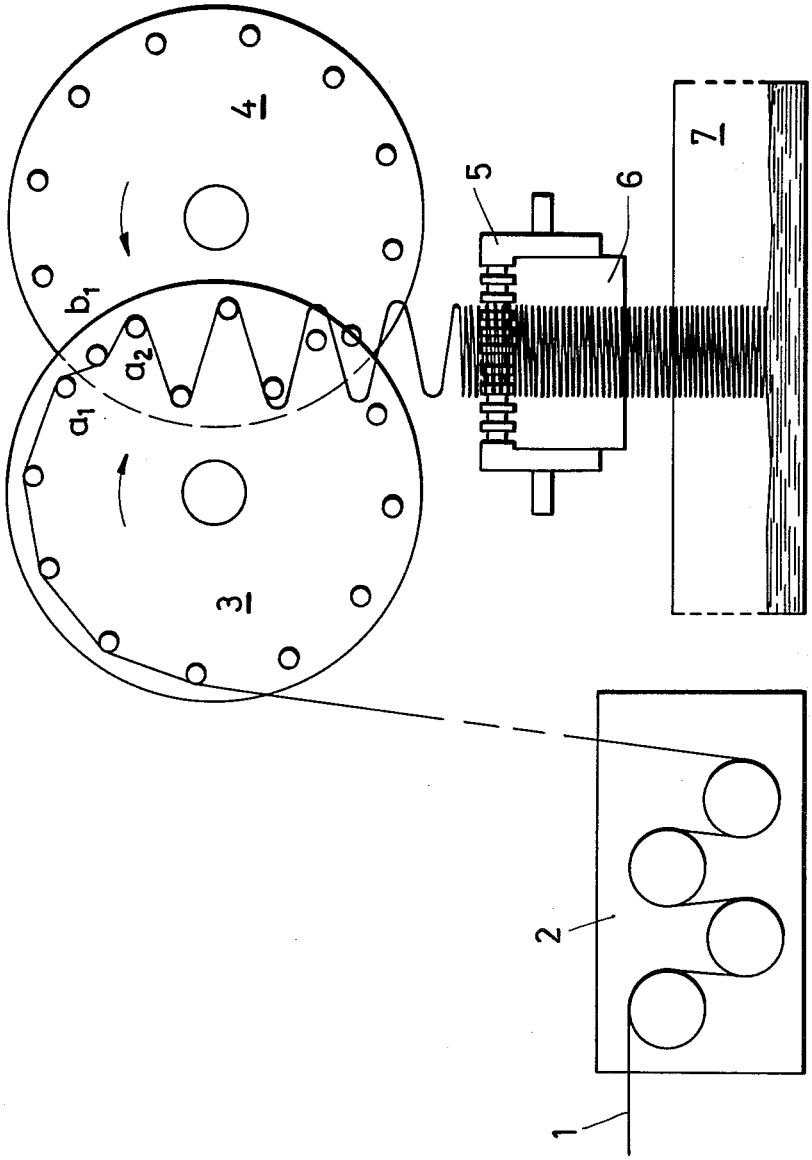
FIG. 1 shows a frontal view of a folding device with a storage can arranged therebelow.
Figure 3:
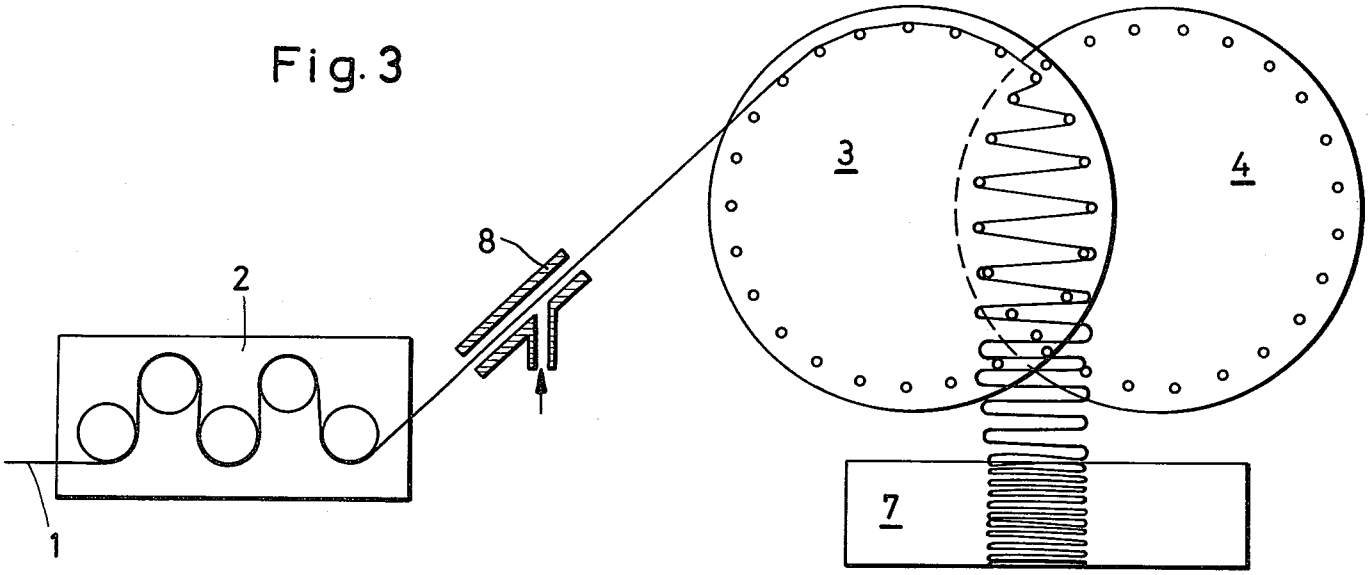
FIG. 3 shows a device similar to that of FIG. 1.
Figure 4:
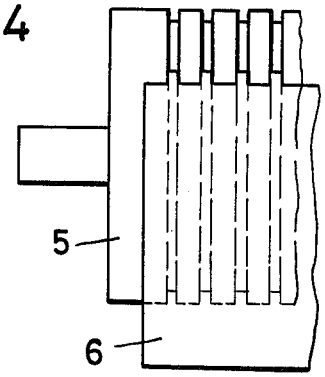
FIG. 4 shows, on an enlarged scale, the conveyor drum arranged underneath the folding device in a plan view.
Figure 5:
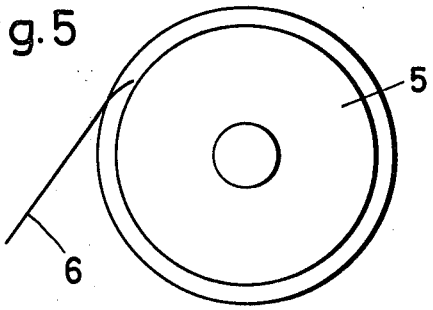
FIG. 5 shows a cross section through the device of FIG. 4.

The strand can readily be threaded to operate the device. Brought into contact with the pins, traveling toward one another, the strand 1 automatically winds itself around the pins in zigzag fashion, in each case outwardly around the pins as seen from the respective wheel axis. Once the strand 1 has passed the center of engagement of the pin-studded wheels, no folding forces are exerted on the strand any londer. Under the effect of centrifugal force, the strand detaches itself from the pins, retaining its loop form, and exits in this loop form from the pair of pin-studded wheels (FIGS. 1 and 3). The loop angle and the loop length are determined by the interengagement of the pin-studded wheels. In any event, this interengagement should be more than 10 mm. By means of these pin-studded wheels, it is readily possible to set interengagement of 50 mm. and more with correspondingly large loop lengths, without there being a danger of pinched zones for the strand.

The folded strand leaving the pin-studded wheels 3 and 4 falls, according to FIGS. 1, 2, onto a revolving drum 5 disposed exactly underneath the falling strand windings, the axis of this drum being arranged at right angles to the axes of the pin-studded wheels. The sudden deceleration of the folds on the drum 5 does not damage the fiber strand, since impingement takes place at right angles to the longitudinal direction of the individual filaments of the fiber strand. Depending on the speed of rotation of the drum 5, a displacement of the folds takes place at the same time so that the individual filaments of a loop, after folding, are superimposed under the final laying angle. Consequently, tangling of the strand and an improver shifting of the already deposited strand are excluded.

The folded strand now leaves the drum under the effect of centrifugal force and gravity, preferably with the additional aid of a further stripper 6, and falls with normal dropping speed, optionally in a slight arc, into the storage can 7 disposed therebelow.

The loop velocity $v_s$ after exiting from the pin-studded wheels depends on the feeding velocity, i.e., for example, the spinning velocity $v_a$, the number of pins, and the meshing of the pin-studded wheels. For example, if the diameter of the pin-studded wheels is 25.2 mm., each wheel has 24 pins of a diameter of 10 mm., and the meshing is 15.3 cm., then the velocity of the loops in relation to the feeding velocity $v_s$ is approximately 0.17 $v_a$.

With a feeding speed of 4000 m./min., this corresponds to a loop velocity $v_s$ of approximately 680 m./min. or a speed of rotation of the pin-studded wheels of barely 500 r.p.m.

A simple calculation demonstrates that the finally attainable effective speed of the strand loops after exiting from the drum 5 amounts to only a fraction of the loop speed $v_s$ after leaving the pin-studded wheels. If 2 L is the length of the strand in the loop, and a is the displacement on the drum with the peripheral speed u, then the following relationship exists: $u=(a/2\ L)\cdot v_s$. For example, if the length L of the loop is 5 cm., the displacement a is 0.7 cm., corresponding to an angle of intersection of about 10°, then $u=0.07\ v_s$, i.e. less than 1/10 of the loop velocity.

An important criterion in the construction of the wheels is that the pins do not come into contact with one another during interengagement and leave enough space for the strand guided threbetween. In the above-cited example, a minimum distance of 8 mm. remains between neighboring pins. Approximately the same relationship can also be achieved with a pair of pin-studded wheels having a diameter of 25.2 cm., an interengagement of 9 cm., and pins of the cross-sectional dimensions of 4×8 mm.; here again, the minimum distance of 8 mm. is maintained.

The strand 1 can be fed to the pair of pin-studded wheels in any desired way. This feeding step can be executed by laying the strand, as illustrated, around the pins of one wheel. In this case, a relative movement takes place between pins and the strand; the latter will slide along these pins, but this is without any substantial significance. It may be advantageous, though, to arrange an additional conveyor, such as the injector nozzle 8 according to FIG. 3, in front of the pair of wheels 3, 4, in order to have a favorable influence on the low-tension feeding of the strand into the pair of wheels 3, 4.

Figure 2B:
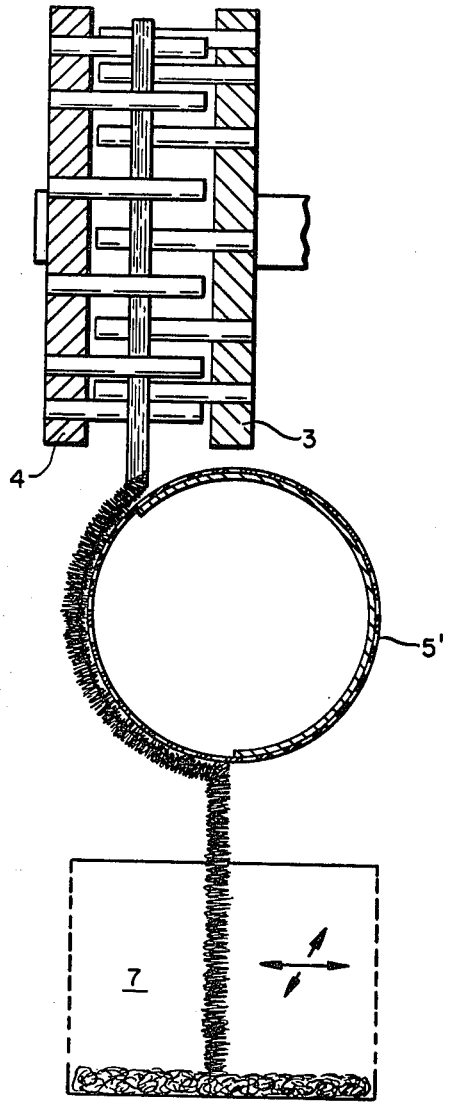
FIG. 2B shows another embodiment of the drum conveyor shown in FIG. 2A.

The drum 5 is advantageous by constructed as a grooved roll (FIG. 1) engaged by the finger-like stripper 6. Thus, any individual filaments adhering to the surface of the drum can be lifted off the surface of the drum without damaging them, since the filaments lie, in correspondence with the loop direction, at right angles to the stripper. Optionally, a sieve drum under a suction draft (as shown in FIG. 2B) can also be used in place of the drum shown in FIG. 2A.

Figure 6:
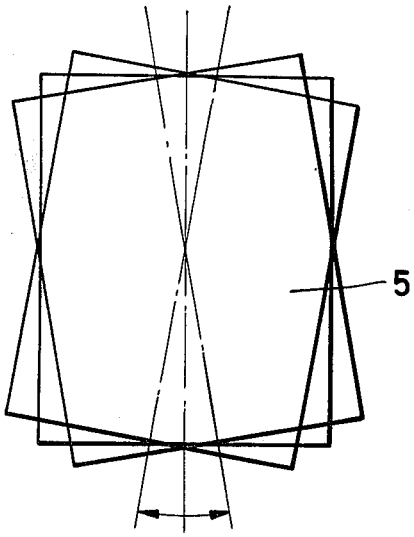
FIG. 6 shows a top view of the drum according to FIG. 4 in various angular positions.

To obtain a more uniform filling of the can, it is advantageous to additionally impart a back and forth motion to the looped strand. This can be accomplished in a very simple way by imparting to the drum 5 a periodical, reciprocating rotary motion about an axis at right angles to the drum a is FIG. 6). The looped strand leaves the drum in each case in the direction of the centrifugal force, the direction of which is constantly changed by the rotation; thus the strand travels from side to side.

The above-described ribbon-like folding performed by pin-studded wheels has the decisive advantage that pinched zones in the strand can no longer occur. The adjustment of the wheels to specific loop lengths is not critical. This adjustment is effected by setting the interengagement of the two pin crowns. With the interengagement of the two pin-studded wheels and their peripheral speed, the tension of the traveling strand can be adjusted between the pin-studded wheels and the preliminary take-off means.

Since, besides the pins, no other component extends into the path of travel of the strand, it is also possible to considerably reduce the diameters of the pin-studded wheels as compared to those of the conventional cogwheels. This results in technical, constructional advantages; furthermore, the danger of coil formation is diminished, inasmuch as the loops, with the same peripheral velocity, are subjected to a greater centrifugal force. To avoid wear on the pins and thus damage to the strand, it is advantageous to choose a ceramic material for the surface of the pins a, b. Thus, the pins can be made, for example, of commercial ceramic tubes with a metallic core.

FIG. 7, as contrasted to the illustrations of FIGS. 1 and 3, additionally shows an intermediate take-off means. From the preliminary take-off means 2, the strand 1 travels to the intermediate take-off means 8, such as an injector nozzle, is seized after intermediate take-off by the threading suction nozzle, not shown, and conducted via thread guide rollers 9 and 10 through a thread brake 11 and through the starting thread guide 12 in the initial position about the pin-studded wheel 4 up to a point below the revolving pair of pin-studded wheels (see FIG. 8). At this point in time, the starting thread guide 12 is brought into the final position according to the arrow in FIG. 8. Thus, the strand 1 is threaded into the pair of pin-studded wheels 3, 4, and the suction nozzle can be turned off. Now the velocity of the pair of pin-studded wheels 3, 4 is reduced to such an extent that no substantial strand tension exists any longer between 12 and 10. Subsequently the thread guide roller 10 is withdrawn from the path of the thread, and the velocity of the pair of pin-studded wheels 3, 4 is fine-regulated so that a free strand loop 13, adjustable at any desired length, hangs between the intermediate take-off means 8 and the thread brake 11. The length of loop 13 can be determined, for example, by a scanner 14 or by an optical control means. This control element then must place the take-off speed of the pair of pin-studded wheels 3, 4 into the desired ideal condition.

According to FIG. 8, the wheel 4 has longer pins than the wheel 3. Thereby a zone results on the pins b of the wheel 4 on which the strand 1 to be threaded can be placed without contact with the pins a of the wheel 3. After shifting the strand 1 with the starting thread guide 12 into the grooves 15 shown enlarged in FIG. 9, the strand is functionally correctly threaded into the pin-studded wheels 3, 4.

I claim:

1. An apparatus for depositing a moving fiber strand as folded loops into a storage means, which comprises a strand feeding device, an intermediate depositing means consisting of two driven wheels rotating in mutually opposite directions and having annularly arranged guide pins for conveying and guiding the strand in a zigzag path to form the strand into a plurality of folded loops, said two wheels being arranged parallel to each other so that the guide pins of each wheel will be successively interspaced during rotation of the wheels and so that the space between the wheels is greater than a length of a guide pin, the pins being axially aligned on each wheel and the pins on each wheel being mutually displaced from each other and being sufficient in number so that more than three pins are simultaneously in contact with the strand during passage through the intermediate depositing means; a conveyor means for receiving the folded loops falling from said intermediate depositing means and for conveying said folded loops so that the loops will be deposited in close juxtaposition within said storage means, said conveyor means being arranged below the intermediate depositing means and above the storage means for decelerating the fall of said loops; and the storage means being arranged for receiving the loops by free fall from the conveyor means; said conveyor means comprising a driven conveyor drum provided with circumferentially parallel grooves engaged by a finger-like strand stripper.

* * * * *